US005475909A

United States Patent [19]

Heil et al.

[11] Patent Number: 5,475,909

[45] Date of Patent: Dec. 19, 1995

[54] THREADING ASSEMBLY FOR A YARN ENTANGLING NOZZLE

[75] Inventors: Karl-Heinz Heil, Oberthulba; Klaus Rippstein, Pfaffenhausen; Hans-Dieter Scherpf, Hammelburg; Klaus Schmidt, Wasserlosen; Günther Schmitt, Pfaffenhausen, all of Germany

[73] Assignee: Temco GmbH & Co. KG, Germany

[21] Appl. No.: 239,361

[22] Filed: May 6, 1994

[30] Foreign Application Priority Data

May 25, 1993 [DE] Germany ..... 93 07 835 U

[51] Int. Cl.[6] ..... D02J 1/08; D02G 1/16

[52] U.S. Cl. ..... 28/272; 28/247; 28/271; 57/279; 57/350

[58] Field of Search ..... 28/254, 268, 271, 28/272; 57/279, 280, 289, 348, 333, 380; 226/97

[56] References Cited

U.S. PATENT DOCUMENTS

| | | | |
|---|---|---|---|
| 3,577,721 | 5/1971 | Schmick et al. | 28/272 X |
| 4,391,090 | 7/1983 | Charbonnier | 57/279 |
| 4,563,799 | 1/1986 | Dammann | 28/272 |
| 4,574,436 | 3/1986 | Cullen, Jr. | 28/272 X |
| 4,574,575 | 3/1986 | Frazen | 57/279 X |
| 4,691,947 | 9/1987 | Burkhardt et al. | 28/272 X |
| 4,856,691 | 8/1989 | Takehana et al. | 57/279 X |

FOREIGN PATENT DOCUMENTS

| | | | |
|---|---|---|---|
| 0023360 | 3/1981 | European Pat. Off. | 28/272 |
| 2220607 | 10/1974 | France . | |
| 3711759 | 3/1988 | Germany | 28/272 |
| 4115368 | 11/1992 | Germany | 28/272 |
| 2024878 | 1/1980 | United Kingdom | 57/279 |
| 2128644 | 4/1984 | United Kingdom . | |

*Primary Examiner*—John J. Calvert

*Attorney, Agent, or Firm*—Ostrolenk, Faber, Gerb & Soffen

[57] ABSTRACT

A yarn entangling device having a housing with an air pressure cushion in it for urging a piston normally outwardly of the housing. The piston has an air passage through it. Shifting the piston outwardly blocks the air passage. A blast nozzle is secured to the piston for being supplied with air through the piston. A baffle plate opposed to the blast nozzle defines a yarn channel. A holder supports the baffle plate for movement away from and into contact with the blast nozzle. With the holder moving the baffle plate toward the blast nozzle, the piston is shifted to open the air passage to the piston, and with the yarn channel opened with the baffle plate away from the blast nozzle, the piston is moved out of the housing by the air pressure cushion cutting off the air flow to the blast nozzle. A closing flap acts through a detent to secure the holder and baffle plate to close the yarn channel.

19 Claims, 4 Drawing Sheets

THREADING ASSEMBLY FOR A YARN ENTANGLING NOZZLE

BACKGROUND OF THE INVENTION

The present invention relates to a yarn entangling device for entangling multifilament yarns and particularly to control over air flow to the device as it is opened.

A large number of yarn entangling devices are known. They use an air blowing nozzle to blow air across the yarn stream passing through the device, Some of them are opened for inserting the thread. The compressed air in the device continues to blow through the blast nozzle while the thread path through the device is open, The operator shuts off the flow of air manually by a barrier, separated from the insertion process. This additional manual operation is frequently overlooked or is started at the wrong time. That produces defective yarn and unnecessarily high consumption of air, One such whirling nozzle is described in Federal Republic of Germany 37 11 759 A1. This nozzle is opened for the insertion of the thread, Although shutting off the feeding of the compressed air is mentioned, there is no indication as to when or how this shut off is to be done.

Federal Republic of Germany 41 15 368 A1 describes a yarn handling device having a nozzle for BCF yarns in which the closing and opening of the device is effected via a pressure cylinder having two compressed air connections. This solution is feasible with the equipment of machines, in which only small quantities are involved. Upon the processing of multifilament yarns where there are up to 200 operating places on one machine, such a nozzle arrangement is uneconomical.

Furthermore, it is important in such a entangling nozzle that the thread can be inserted into the yarn channel linearly and in a manner visible to the operating personnel, without danger of slippage or even jamming of the thread.

SUMMARY OF THE INVENTION

The object of the present invention is to improve a yarn entangling device, wherein linear travel of the thread is maintained, compressed air is fed in a positive fashion upon the closing of the nozzle, and the compressed air is turned off in a positive fashion upon the opening of the nozzle.

The invention concerns a yarn entangling device having a housing with an air pressure cushion in it for urging a piston normally outwardly of the housing. The piston has an air passage through it, and shifting the piston outwardly blocks the air passage. A blast nozzle secured to the piston is supplied with air through the piston passage. A baffle plate opposed to the blast nozzle defines a yarn channel. A holder supports the baffle plate for movement away from and into contact with the blast nozzle. With the holder moving the baffle plate through the blast nozzle, the piston is shifted to open the air passage to the piston, and with the yarn channel opened with the baffle plate away from the blast nozzle, the piston is moved out of the housing by pressure in the air cushion which cuts off the air flow to the blast nozzle. A closing flap through a detent secures the holder and baffle plate to close the yarn channel.

The yarn entangling device is provided with a compressed air piston which is held in and is movable by a compressed air cushion. The blast nozzle, which also contains the yarn channel, is introduced onto the piston. The air pathway from the air cushion to the blast nozzle is through an air passage through the piston. The air passage into the piston has an inlet which is blocked by movement of the piston under air pressure when the nozzle is open for enabling yarn threading. When the nozzle is closed, this moves the piston to open the air passage inlet. The baffle plate on the side of the yarn channel across from the blast nozzle cooperates with the blast nozzle outlet side of the piston to define the yarn channel. The baffle plate is arranged in a holder which is movable, and preferably swingable by a torsion spring, with respect to the housing. The holder also supports the entrance and exit thread guides above and below the ends of the yarn channel. The thread guides can be adjusted at given angles to the yarn channel.

An opening and closing flap opposes or permits swinging open of the holder. The flap is designed for swinging and is acted on by a compression spring which biases the flap normally closed. The holder is provided with a respective locking detent arranged at the height of each thread guide, into which detent there engages a respective detent nose which is arranged on the opening and closing flap.

The entangling device is closed manually. After insertion of the thread into the yarn channel, the holder is moved in the direction toward the blast nozzle and closes the open yarn channel. Slight pressure on the holder causes it to be engaged by the opening and closing flap. The compressed air piston is urged forward, i.e. outward, by the air cushion to a position to close the inlet passage to the blast nozzle. The piston is pushed rearward by its contact with the baffle plate against the compressed air cushion. The piston is pushed back enough to open the air feed to the blast nozzle to provide a free path for the compressed air to the yarn channel. The nozzle is again in operation.

In the entangling device, the opening and closing flap is moved against a pressure spring. Upon release of the holding flap, the holder is automatically opened by the torsion spring to expose the yarn channel. At the same time, the compressed air cushion moves the compressed air piston forward enough to block the feeding of compressed air through the inlet passage.

An advantage of this entangling device is that the compressed air piston can be provided with another blast nozzle by simply removing the nozzle then in place and remounting another. In this connection, of course, both the yarn channel and the compressed air feed are adapted to the deniers of the yarns to be entangled. Thus, by replacement of the yarn nozzle, yarns of different tex can be entangled using only a single entangling device.

The entangling device has the further advantage that it can be used either on the left or on the right side of the operator, the direction of travel of the thread (from top to bottom or from bottom to top) being frequently important.

In addition to the manner of operation of the holder described above, the entangling device can, of course, also be opened and/or closed by linear lever movements of the holder.

Other objects and features of the invention are explained below with reference to examples.

DESCRIPTION OF THE PREFERRED EMBODIMENTS

Figure 1:
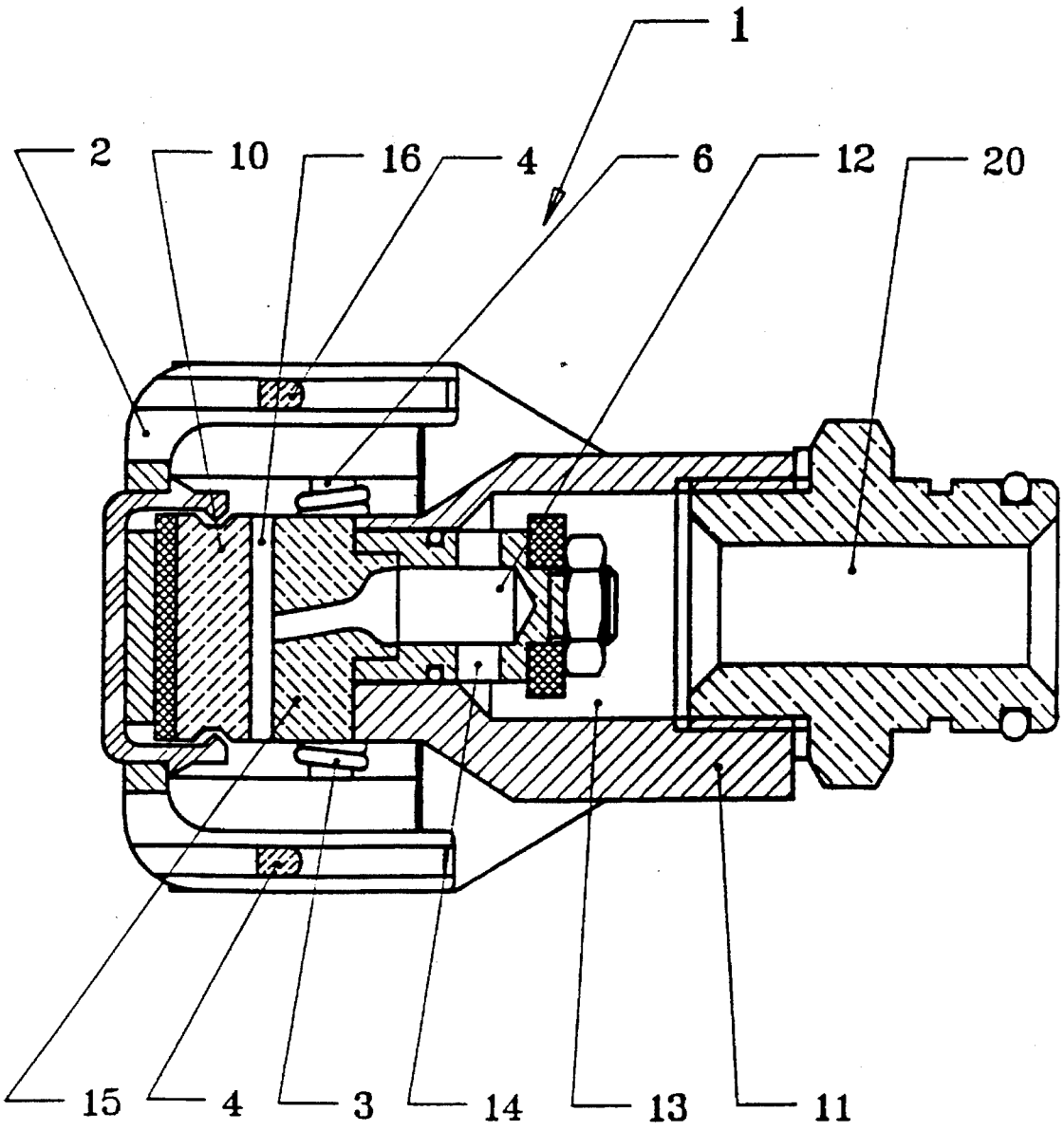
FIG. 1 is a sectional side view of an entangling device of the invention in closed condition.

In FIG. 1, a yarn entangling device 1 is shown in its closed operating position. The device 1 includes a housing 11 and a holder 2 secured to and movable with respect to the housing 11. The baffle plate 10 supported by and movable with the holder 2 causes the baffle plate to close the yarn channel 16 at the outlet from the blast nozzle 15.

The nozzle 15 is connected to the outlet side of the axially shiftable compressed air piston 12. The piston 12 is supported in an extended length slide passage through the wall of the housing 11 and projects from the inside of the housing 11. The rear end of the piston extends from the air cushion 13 to the nozzle 15 attached at the front of the piston and which is outside the housing 11.

Through its air inlet connection 20, compressed air is conducted into the entangling housing 11 and forms a compressed air cushion at 13 around and behind the piston 12. The compressed air passes from the compressed air cushion 13 via the air inlet hole 14 into the air passage through the piston 12 and into the blast nozzle 15 and out the exit from the nozzle. The blast nozzle 15 blows into the yarn channel 16 which is closed off and defined by the baffle plate 10 opposed to the outlet from the nozzle 15.

The torsion spring 3 normally urges the holder 2 to swing outward upon the opening of the channel 16 around the pivot point 6 of the holder 2.

Adjustable thread guides 4 are installed on the top and on the bottom of and are firmly attached to the holder 2. The yarn threads pass through both thread guides 4 on their path through the yarn channel 16.

Figure 2:
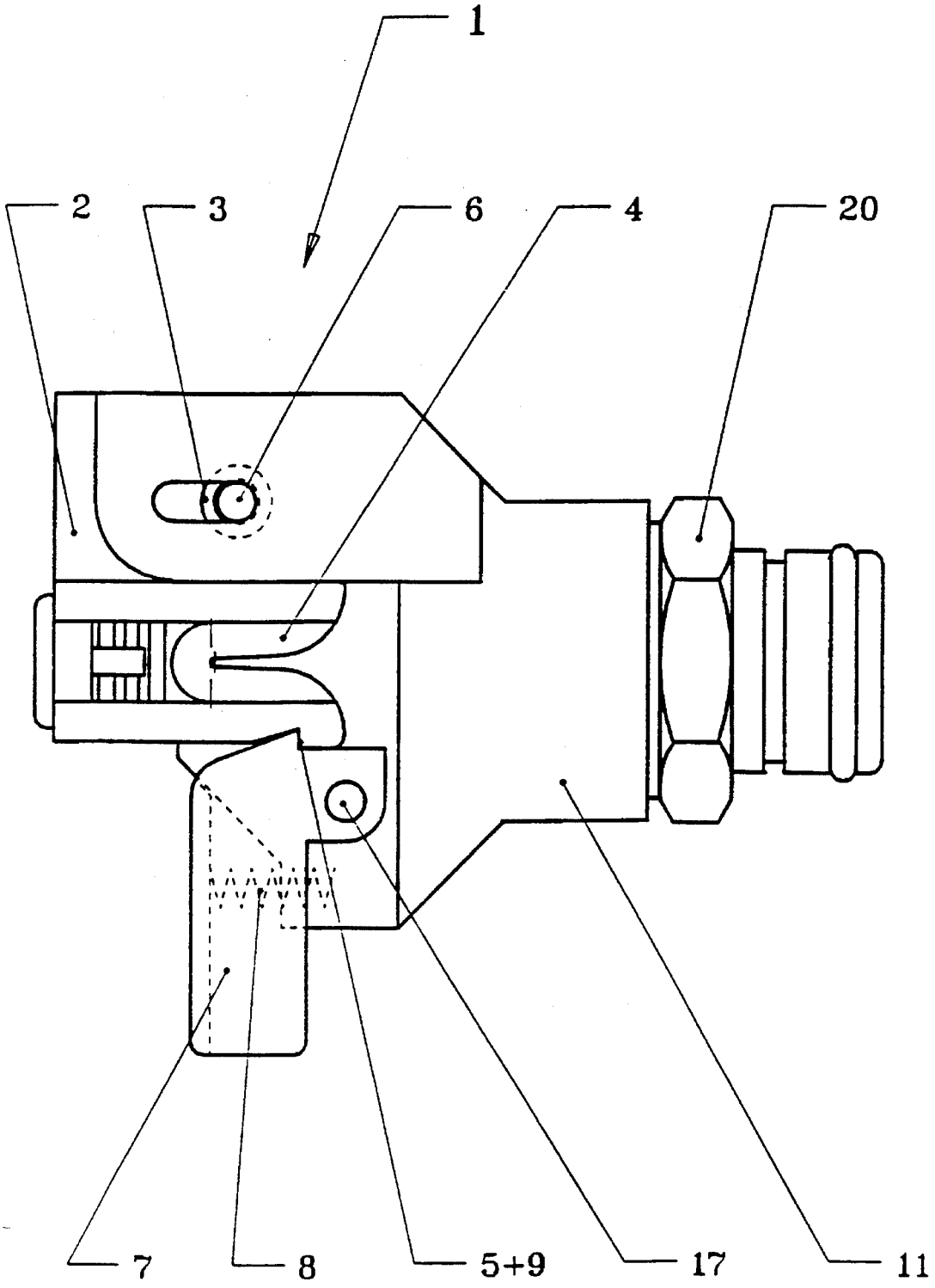
FIG. 2 is a top view of the entangling device in closed condition.

FIG. 2 is a top view showing the entangling device 1 in the operating position of FIG. 1. The housing 11 has an inlet connection 20 through which the compressed air is introduced. The holder 2 is mounted for swinging open at the pivot point 6 by the torsion spring 3. The thread guide 4 is shown arranged in the holder 2.

An opening and closing flap 7 is movable around the pivot point 17 against the compression spring 8 to free the holder 2. The spring normally urges the flap to its illustrated blocking position. The locking of the holder 2 as well as of the opening and closing flap 7 is effected via the detent 5 on the holder 2 which is engaged by the detent nose 9 on the closing flap 7.

Figure 3:
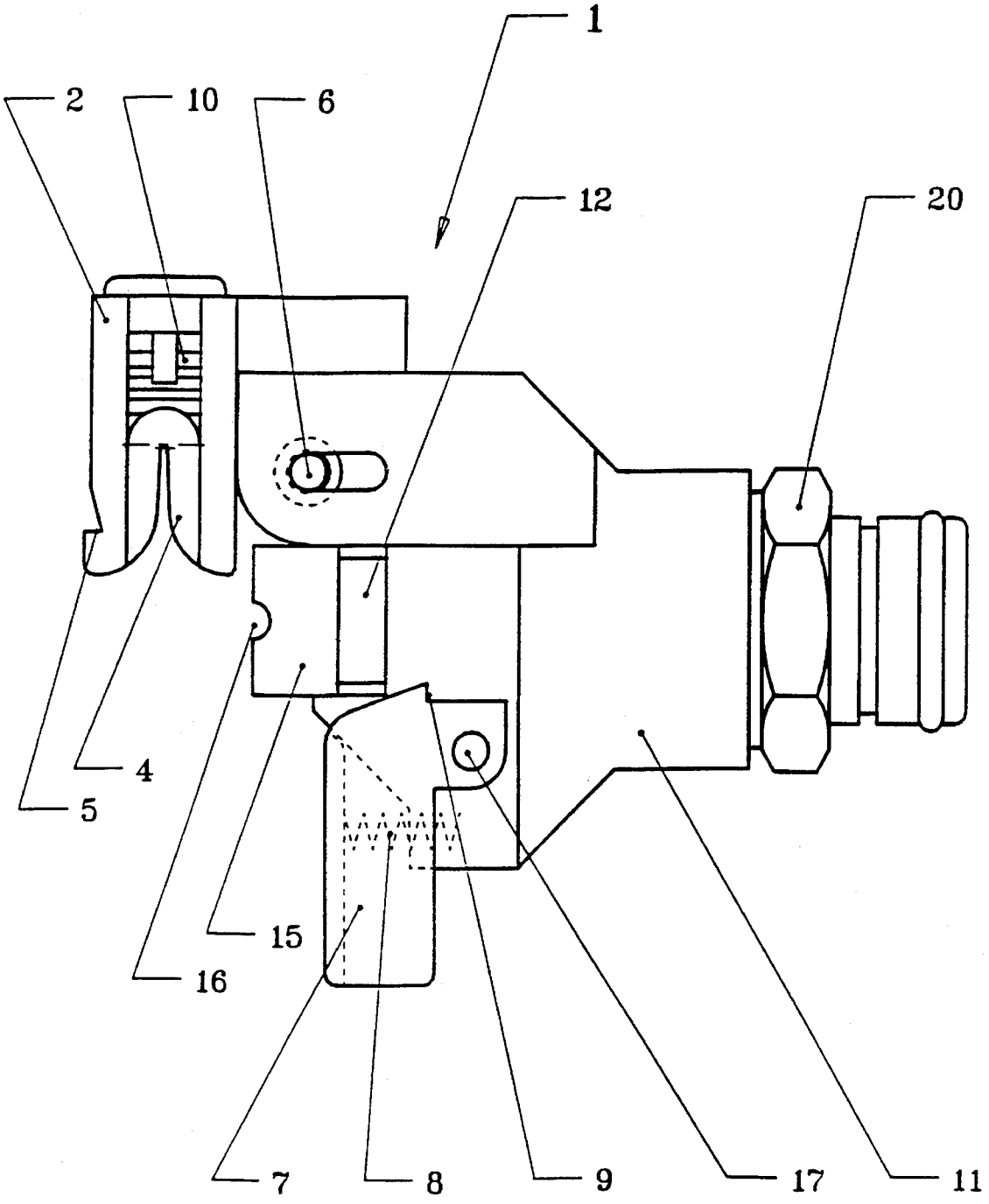
FIG. 3 is a top view of the entangling device in open condition.

FIG. 3 shows a top view of the entangling device in its open condition. The housing 11 has the air inlet connection 20. The holder 2 in which the baffle plate 10 is installed is swung out at the pivot point 6. The compressed air piston 12 together with the blast nozzle 15, at which nozzle the yarn channel 16 is located, is now free of the force applied by holder 2 to the piston. The piston 12 and nozzle 15 have shifted to the left in FIG. 3, as compared to its position in FIG. 1, under the influence of pressure in the chamber 13 on the piston 12. This movement closes the air inlet hole 14 (not visible in FIG. 3 since the inlet hole is blocked by the wall of the passage for the piston). The thread guide 4 can be noted at the head end of the holder 2. The detent 5 for locking of the holder 2 is also visible on the holder 2. The opening and closing flap 7 is movable around the pivot point 17 against the compression spring 8. The detent nose 9 for the locking in the holder 2 can be seen on the opening and closing flap 7.

Figure 4:
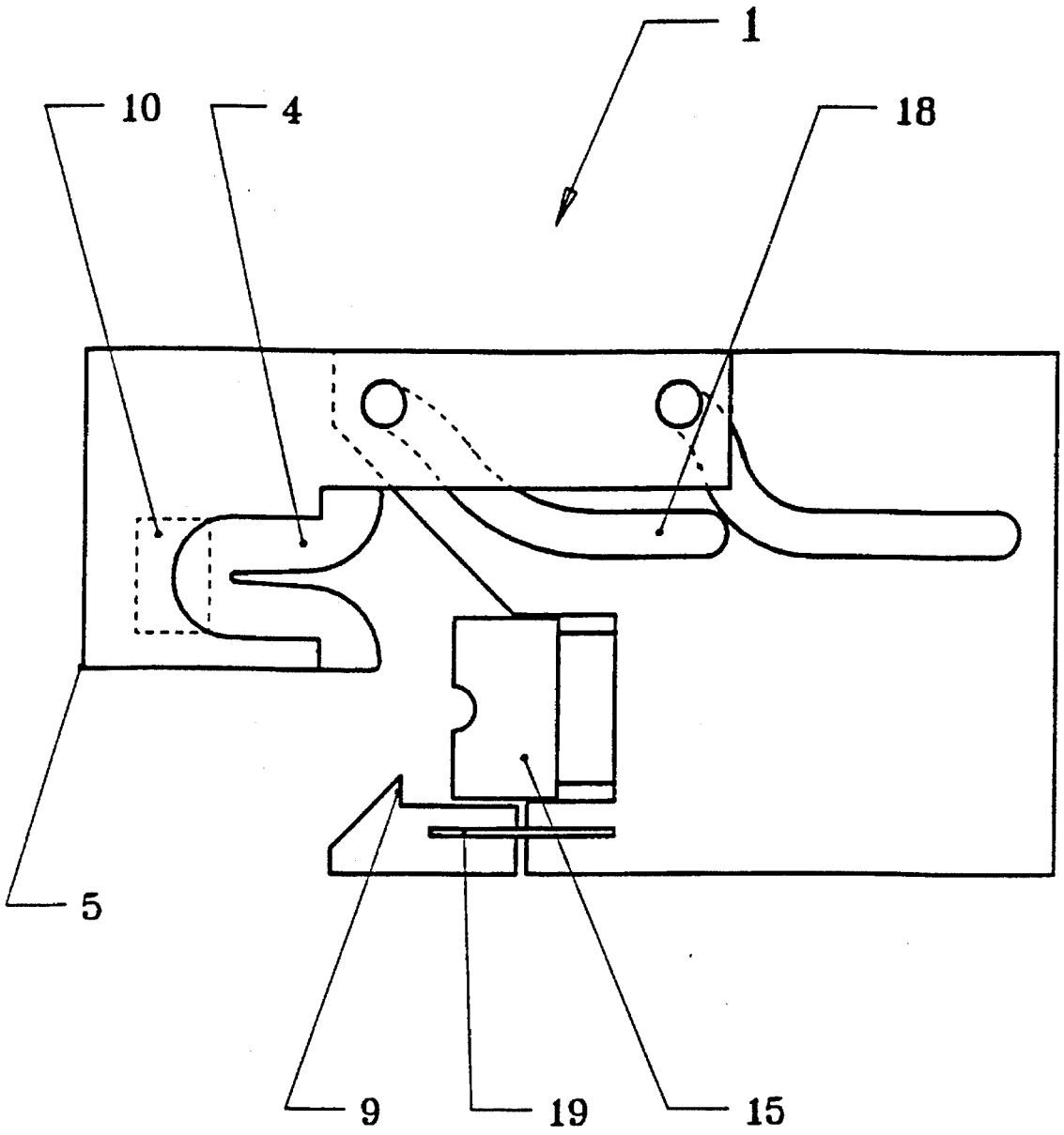
FIG. 4 shows a variant of the entangling device in which the opening and closing is effected linearly.

FIG. 4 shows a variant for opening and closing the entangling device 1. In this case, the baffle plate 10 along with the thread guides 4 are moved along the direction of the blast nozzle 15 via a parallel displacement, through motion guide channels 18. Similarly, the opening and closing flap is actuated by a guide element 19. The locking is effected again via a detent 5 on the baffle plate holder as well as a detent nose 9 on the guide element 19. The other functions are not impaired by those already described.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A yarn entangling device for multifilament yarns, comprising:

a housing having a compressed air inlet and a chamber within for defining an air pressure cushion;

a piston supported for linear movement in the housing and extending into the compressed air cushion, the piston extending through a passage out of the housing and out of the compressed air cushion; the piston having a side facing out of the housing; an air passage communicating through the piston and having an outlet through the side of the piston facing out of the housing, the air passage through the piston having an inlet on the piston placed such that with the piston moved into the housing, the inlet to the air passage is exposed to the air cushion, and with the piston moved more out of the housing, the housing supporting the piston blocks the inlet to the air passage;

a blast nozzle attached to and moveable with the piston and including a nozzle inlet communicating with the piston outlet; the blast nozzle having an outlet surface with a shape for defining a yarn channel; an air pathway through the blast nozzle from the piston air outlet and to a blast nozzle outlet into the yarn channel for delivering an air blast from the housing into the yarn channel;

a baffle plate opposed to the blast nozzle outlet and cooperating with the blast nozzle for defining the yarn channel which extends past the blast nozzle outlet;

a holder on which the baffle plate is supported; the holder being moveable to a closed operating position which supports the baffle plate against the blast nozzle for urging the piston into the housing sufficiently for opening the inlet to the air passage through the piston, and the holder being manually pivotable to an open piston for moving the baffle plate away from the blast nozzle, thereby manually freeing the piston for being moved so as to block the air inlet through the air passage through the piston when the baffle plate is away from the blast nozzle and the yarn channel is thereby opened;

a manually operable closing device operable for securing the holder to the housing for moving the baffle plate against the blast nozzle for opening the air inlet passage to the piston, and the closing device being operable for releasing the holder to move with the baffle plate away from the blast nozzle, to free the piston and thereby close the air inlet to the air passage through the piston;

the closing device comprising an opening and closing flap which is supported on the housing and is moveable with respect to the housing so as to engage the holder when the holder is in the closed position with the baffle plate at the yarn channel, and the flap being operable to release the holder to be opened into the open position away from the blast nozzle.

2. The device of claim 1, further comprising thread guides supported to the holder and positioned with respect to the yarn channel so as to guide thread passing through the yarn channel when the yarn channel is closed.

3. The device of claim 1, wherein the holder is pivotable at least 90° about the pivot.

4. The device of claim 1, further comprising biasing means for normally urging the holder to the open position with the baffle plate away from the blast nozzle.

5. The device of claim 4, further comprising a pivot for the holder to pivot the holder between the open and closed position.

6. The device of claim 5, wherein the holder is selectively pivotally mountable at a pivot at opposite sides of the yarn channel for selectively pivoting open to the left and the right.

7. The device of claim 1, wherein the blast nozzle is selectively attachable to and removable from the piston for enabling equipping the piston with a selected blast nozzle for satisfying operational criteria.

8. The device of claim 7, wherein the holder is pivotable at least 90° about the pivot.

9. The device of claim 1, further comprising biasing means for normally urging the holder to the open position with the baffle plate away from the blast nozzle; a pivot for the holder at the whirling housing to pivot the holder between the open and closed position.

10. The device of claim 1, wherein the holder is supported to the whirling device for movement substantially linearly for moving the baffle plate toward and away from the blast nozzle, and guide means for guiding the holder for moving linearly.

11. The device of claim 1, wherein there is a cushion of compressed air in the housing and the piston is in the compressed air cushion for being urged out of the housing.

12. A yarn entangling device for multifilament yarns, comprising:

a housing having a compressed air inlet and a chamber within for defining an air pressure cushion;

a piston supported in the housing and extending into the compressed air cushion, the piston extending through a passage out of the housing and out of the compressed air cushion; the piston having a side facing out of the housing; an air passage communicating through the piston and having an outlet through the side of the piston facing out of the housing, the air passage through the piston having an inlet on the piston placed such that with the piston moved into the housing, the inlet to the air passage is exposed to the air cushion and with the piston moved more out of the housing, the housing supporting the piston blocks the inlet to the air passage;

a blast nozzle attached to and moveable with the piston and including a nozzle inlet communicating with the piston outlet; the blast nozzle having an outlet surface with a shape for defining a yarn channel; an air pathway through the blast nozzle from the piston air outlet and to a blast nozzle outlet into the yarn channel for delivering an air blast from the housing into the yarn channel;

a baffle plate opposed to the blast nozzle outlet and cooperating with the blast nozzle for defining the yarn channel which extends past the blast nozzle outlet;

a holder on which the baffle plate is supported; the holder being moveable to a closed operating position which supports the baffle plate against the blast nozzle for urging the piston into the housing sufficiently for opening the inlet to the air passage through the piston, and the holder being moveable to an open piston for moving the baffle plate away from the blast nozzle, thereby freeing the piston for being moved so as to block the air inlet through the air passage through the piston when the baffle plate is away from the blast nozzle and the yarn channel is thereby opened;

a closing device operable for securing the holder to the housing for moving the baffle plate against the blast nozzle for opening the air inlet passage to the piston, and the closing device being operable for releasing the holder to move with the baffle plate away from the blast nozzle, to free the piston and thereby close the air inlet to the air passage through the piston;

the closing device comprising an opening and closing flap which is supported on the housing and is moveable with respect to the housing so as to engage the holder when the holder is in the closed position with the baffle plate at the yarn channel, and the flap being operable to release the holder to be opened into the open position away from the blast nozzle;

biasing means for normally urging the holder to the open position with the baffle plate away from the blast nozzle;

a pivot for the holder to pivot the holder between the open and closed position; and a spring connected with the holder for causing the holder to pivot to move the baffle plate away from the blast nozzle.

13. The device of claim 12, wherein the holder is pivotable at least 90° about the pivot.

14. A yarn entangling device for multifilament yarns, comprising:

a housing having a compressed air inlet and a chamber within for defining an air pressure cushion;

a piston supported in the housing and extending into the compressed air cushion, the piston extending through a passage out of the housing and out of the compressed air cushion; the piston having a side facing out of the housing; an air passage communicating through the piston and having an outlet through the side of the piston facing out of the housing, the air passage through the piston having an inlet on the piston placed such that with the piston moved into the housing, the inlet to the air passage is exposed to the air cushion and with the piston moved more out of the housing, the housing supporting the piston blocks the inlet to the air passage;

a blast nozzle attached to and moveable with the piston and including a nozzle inlet communicating with the piston outlet; the blast nozzle having an outlet surface with a shape for defining a yarn channel; an air pathway through the blast nozzle from the piston air outlet and to a blast nozzle outlet into the yarn channel for delivering an air blast from the housing into the yarn channel;

a baffle plate opposed to the blast nozzle outlet and cooperating with the blast nozzle for defining the yarn channel which extends past the blast nozzle outlet;

a holder on which the baffle plate is supported; the holder being moveable to a closed operating position which supports the baffle plate against the blast nozzle for urging the piston into the housing sufficiently for opening the inlet to the air passage through the piston, and the holder being moveable to an open piston for moving the baffle plate away from the blast nozzle, thereby freeing the piston for being moved so as to block the air inlet through the air passage through the piston when the baffle plate is away from the blast nozzle and the yarn channel is thereby opened;

a closing device operable for securing the holder to the housing for moving the baffle plate against the blast nozzle for opening the air inlet passage to the piston, and the closing device being operable for releasing the holder to move with the baffle plate away from the blast nozzle, to free the piston and thereby close the air inlet to the air passage through the piston;

the closing device comprising an opening and closing flap which is supported on the housing and is moveable with respect to the housing so as to engage the holder when the holder is in the closed position with the baffle plate at the yarn channel, and the flap being operable to release the holder to be opened into the open position away from the blast nozzle;

biasing means for normally urging the holder to the open position with the baffle plate away from the blase nozzle; and a pivot for the holder to pivot the holder between the open and closed position;

wherein the biasing means comprises a torsion spring attached to the holder at the pivot thereof.

15. The device of claim 14, wherein the holder is pivotable at least 90° about the pivot.

16. A yarn entangling device multifilament yarns, comprising:

a housing having a compressed air inlet and a chamber within for defining an air pressure cushion;

a piston supported in the housing and extending into the compressed air cushion, the piston extending through a passage out of the housing and out of the compressed air cushion; the piston having a side facing out of the housing; an air passage communicating through the piston and having an outlet through the side of the piston facing out of the housing, the air passage through the piston having an inlet on the piston placed such that with the piston moved into the housing, the inlet to the air passage is exposed to the air cushion and with the piston moved more out of the housing, the housing supporting the piston blocks the inlet to the air passage;

a blast nozzle attached to and moveable with the piston and including a nozzle inlet communicating with the piston outlet; the blast nozzle having an outlet surface with a shape for defining a yarn channel; an air pathway through the blast nozzle from the piston air outlet and to a blast nozzle outlet into the yarn channel for delivering an air blast from the housing into the yarn channel;

a baffle plate opposed to the blast nozzle outlet and cooperating with the blast nozzle for defining the yarn channel which extends past the blast nozzle outlet;

a holder on which the baffle plate is supported; the holder being moveable to a closed operating position which supports the baffle plate against the blast nozzle for urging the piston into the housing sufficiently for opening the inlet to the air passage through the piston, and the holder being moveable to an open piston for moving the baffle plate away from the blast nozzle, thereby freeing the piston for being moved so as to block the air inlet through the air passage through the piston when the baffle plate is away from the blast nozzle and the yarn channel is thereby opened;

a closing device operable for securing the holder to the housing for moving the baffle plate against the blast nozzle for opening the air inlet passage to the piston, and the closing device being operable for releasing the holder to move with the baffle plate away from the blast nozzle, to free the piston and thereby close the air inlet to the air passage through the piston;

the closing device comprising an opening and closing flap which is supported on the housing and is moveable with respect to the housing so as to engage the holder when the holder is in the closed position with the baffle plate at the yarn channel, and the flap being operable to release the holder to be opened into the open position away from the blast nozzle;

biasing means for normally urging the holder to the open position with the baffle plate away from the blase nozzle;

a pivot for the holder to pivot the holder between the open and closed position; and a detent on the holder and a detent nose on the closing flap, and the respective detent and detent nose being selectively connectable and separable for locking the holder closed to the housing.

17. The device of claim 16, wherein the holder is pivotable at least 90° about the pivot.

18. A yarn entangling device for multifilament yarns, comprising:

a housing having a compressed air inlet and a chamber within for defining an air pressure cushion;

a piston supported in the housing and extending into the compressed air cushion, the piston extending through a passage out of the housing and out of the compressed air cushion; the piston having a side facing out of the housing; an air passage communicating through the piston and having an outlet through the side of the piston facing out of the housing, the air passage through the piston having an inlet on the piston placed such that with the piston moved into the housing, the inlet to the air passage is exposed to the air cushion and with the piston moved more out of the housing, the housing supporting the piston blocks the inlet to the air passage;

a blast nozzle attached to and moveable with the piston and including a nozzle inlet communicating with the piston outlet; the blast nozzle having an outlet surface with a shape for defining a yarn channel; an air pathway through the blast nozzle from the piston air outlet and to a blast nozzle outlet into the yarn channel for delivering an air blast from the housing into the yarn channel;

a baffle plate opposed to the blast nozzle outlet and cooperating with the blast nozzle for defining the yarn channel which extends past the blast nozzle outlet;

a holder on which the baffle plate is supported; the holder being moveable to a closed operating position which supports the baffle plate against the blast nozzle for urging the piston into the housing sufficiently for opening the inlet to the air passage through the piston, and the holder being moveable to an open piston for moving the baffle plate away from the blast nozzle, thereby freeing the piston for being moved so as to block the air inlet through the air passage through the piston when the baffle plate is away from the blast nozzle and the yarn channel is thereby opened;

a closing device operable for securing the holder to the housing for moving the baffle plate against the blast nozzle for opening the air inlet passage to the piston, and the closing device being operable for releasing the holder to move with the baffle plate away from the blast nozzle, to free the piston and thereby close the air inlet to the air passage through the piston;

the closing device comprising an opening and closing flap which is supported on the housing and is moveable with respect to the housing so as to engage the holder when the holder is in the closed position with the baffle plate at the yarn channel, and the flap being operable to release the holder to be opened into the open position away from the blast nozzle;

wherein the flap is pivotally supported to the housing to pivot between the open and closed positions; a spring connected with the flap for normally urging the flap to the position which would hold the holder so that the baffle plate closes the yarn channel with the blast nozzle, and cooperating detent means on the closing flap and on the holder so that the closing flap releasibly holds the holder closed forward of the blast nozzle.

19. The device of claim 18, wherein the holder is pivotable at least 90° about the pivot.

* * * * *